US006671912B1

(12) United States Patent
Tsai et al.

(10) Patent No.: US 6,671,912 B1
(45) Date of Patent: Jan. 6, 2004

(54) MODULATED AIR CUSHION

(76) Inventors: Tien-Min Tsai, 2F-3, No. 11, Lane 250, Sec. 5, Nanking E. Rd., Taipei (TW); Jen-Hsiu Tsai, 2F-3, No. 11, Lane 250, Sec. 5, Nanking E. Rd., Taipei (TW)

( * ) Notice: Subject to any disclaimer, the term of this patent is extended or adjusted under 35 U.S.C. 154(b) by 0 days.

(21) Appl. No.: 10/244,251

(22) Filed: Sep. 16, 2002

(51) Int. Cl.[7] ..... A47C 27/10
(52) U.S. Cl. ..... 5/713; 5/710
(58) Field of Search ..... 5/710, 713

(56) References Cited

U.S. PATENT DOCUMENTS 2,998,817 A * 9/1961 Armstrong ..... 5/713 X
5,634,225 A * 6/1997 Miller, Sr. et al. ..... 5/710
5,647,078 A * 7/1997 Pekar ..... 5/710 X
6,321,404 B1 * 11/2001 Tsai ..... 5/710 X

* cited by examiner

*Primary Examiner*—Teri Pham Luu
*Assistant Examiner*—Sunil Singh
(74) *Attorney, Agent, or Firm*—Dellett & Walters

(57) ABSTRACT

A modulated air cushion includes a base having a top face, multiple air pouches removably attached to the top face of the base in a matrix arrangement via a bonding device. Each air pouch has an inlet formed on the air pouch. An air pump is provided to have a controller and at least two tubes connected to the controller. Each of the at least two tubes integrally have branches each provided with multiple air nozzles corresponding to the inlets of the air pouches. The air pump is able to inflate air pouches in odd and even columns or odd and even rows independently or simultaneously.

3 Claims, 9 Drawing Sheets

MODULATED AIR CUSHION

BACKGROUND OF THE INVENTION

1. Field of the Invention

The present invention relates to a modulated air cushion, and more particularly to a modulated air cushion having multiple air pouches removably connected to a top face of a base so that the user is able to freely design the area to fulfill the requirement by removing unnecessary cushion unit.

2. Description of Related Art

An air cushioned bed provides comfort to the user and because of a controller, the air cushioned bed is able to vary the shape to fulfill the needs of the user.

A U.S. Pat. No. 5,564,142 disclosed an air mattress including multiple air sacs juxtapositionally and transversely secured on a mattress envelope. Each of the air sacs are elongated so that after the air sacs are arranged on the mattress envelope side by side with one another, the air pump is able to simultaneously or independently inflate the air sacs. Because the air sacs can be inflated independently or simultaneously, the shape of the air cushion is changed. Thus the user is able to determine the shape of the air cushion to cope with different situations. However, if a patient with burned trauma is lying on the air cushion of this kind. It is crucial that the damaged skin is provided with enough air for recovery. Because each of the air sacs can not be adjusted to the area of the burned skin, the damaged skin will never have enough air for healing.

With reference to FIG. 8, a conventional air cushioned bed is presented and has a base (71) with multiple loops (70) formed on a top face of the base (71), an air pump (72) with a controller (721) and two air tubes (722), an integrally formed air capsules (73) inflatable by the air pump (72) and a mattress (75).

When the air cushioned bed is in use, the integrally formed air capsules (73) are positioned on top of the base (71) by the loops (70). When the user wants to change the inflated area to cope with a burned skin, due to the air capsules (73) being integral, the user can not fulfill the requirement to change the inflated area so as to provide sufficient air to the injured skin.

With reference to FIG. 9, another conventional air cushioned bed is provided to have sacs (83) each having two pairs of holes (831) respectively defined on opposite end faces of the sac (83). A tape (81) is provided around the sacs (83) and has multiple pairs of buttons (811) each formed to correspond to one pair of the holes (831) so that the tape (81) is able to secure the sacs (83) by extending each of the buttons (811) into a corresponding one of the holes (831). Further a cover (85) is provided on top of the sacs (83) and has multiple securing holes (851) defined to correspond to a corresponding one of the pair of buttons (811). After the sacs (83) are secured by the tape (81), the cover (85) is able to cover the top of the sacs (83) to complete the assembly of the air cushioned bed. Although the positioning manner to the capsules (73), the sacs (83) is not the same, both conventional air cushioned bed suffer from the same problem. That is, the size, shape and contour of the cushion can not be varied according to different requirements.

To overcome the shortcomings, the present invention tends to provide an improved modulated air cushion to mitigate and obviate the aforementioned problems.

SUMMARY OF THE INVENTION

The primary objective of the present invention is to provide an improved modulated air cushion which has multiple air pouches each removably connected to a top face of the base so that the user is able to free remove any one of the unnecessary air pouch to define an area suitable for a specific purpose.

Another objective of the present invention is to provide an air pump having two air tubes respectively having multiple nozzles corresponding to air inlets defined in each of the air pouches so that the air pump is able to inflate each of the air pouch independently or simultaneously.

In order to accomplish the foregoing objective, the modulated air cushion of the present invention includes a base, multiple air pouches removably connected to a top face of the base, an air pump having at least two tubes each having thereon multiple nozzles to correspond to inlets respectively formed on one of the air pouches so that the air pump is able to inflate the air pouches simultaneously or independently depending on the controller of the air pump and a cover sheet provided on top of the air pouches.

Other objects, advantages and novel features of the invention will become more apparent from the following detailed description when taken in conjunction with the accompanying drawings.

DETAILED DESCRIPTION OF THE PREFERRED EMBODIMENT

Figure 1:
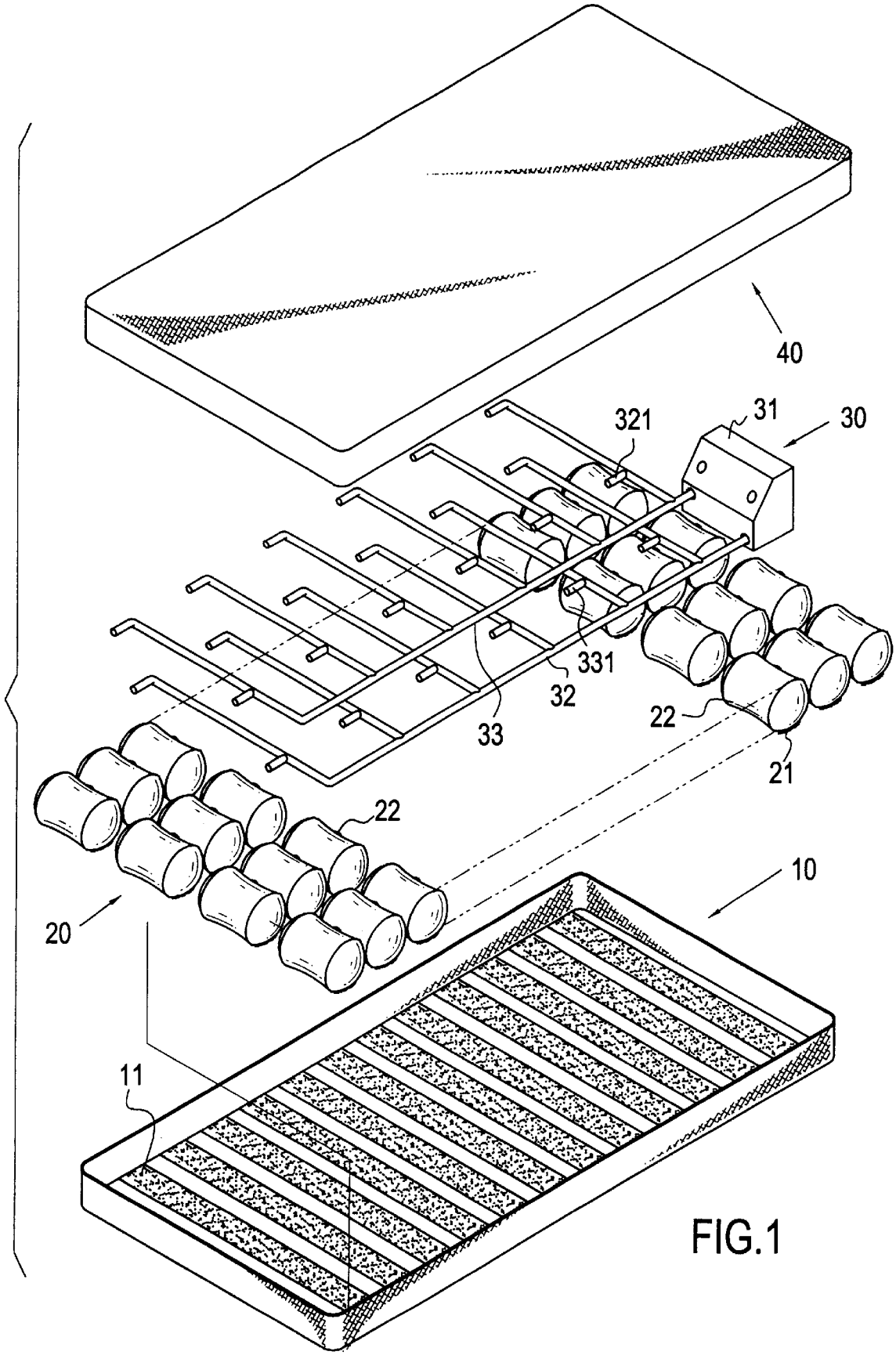
FIG. 1 is an exploded perspective view of the modulated air cushion of the present invention.

With reference to FIG. 1, the modulated air cushion in accordance with the present invention includes a base (10), multiple air pouches (20), an air pump (30) and a cover sheet (40).

The base (10) has a top face provided with a first bonding element (11).

Each of the air pouches (20) has a second bonding element (21) formed on a bottom face of the air pouch (20) to correspond to the first bonding element (11) and an inlet (22) formed on a side face of the air pouch (20). Preferably, the air pouches (20) are provided on the top face of the base (10) via a hook and loop combination. That is, the first bonding element (11) and second bonding element (21) are the hook and loop combination. The hook and loop combination is generally called Velcro™. After the air pouches (20) are arranged on the top face of the base (10), it is noted that, preferably, the arrangement of the air pouches (20) is by a matrix manner.

The air pump (30) has a controller (31) and at least two tubes (32,33) extending out from the controller (31). Each of the two tubes (32,33) have multiple air nozzles (321,331) corresponding to the inlets (22) of the air pouches (20) so that the air pump (30) is able to inflate the air pouches (20). The cover sheet (40) is used to cover top faces of the air pouches (20) after the air pouches (20) are arranged on top of the base (10) so that the user is able to have a generally flat surface.

Figure 2:
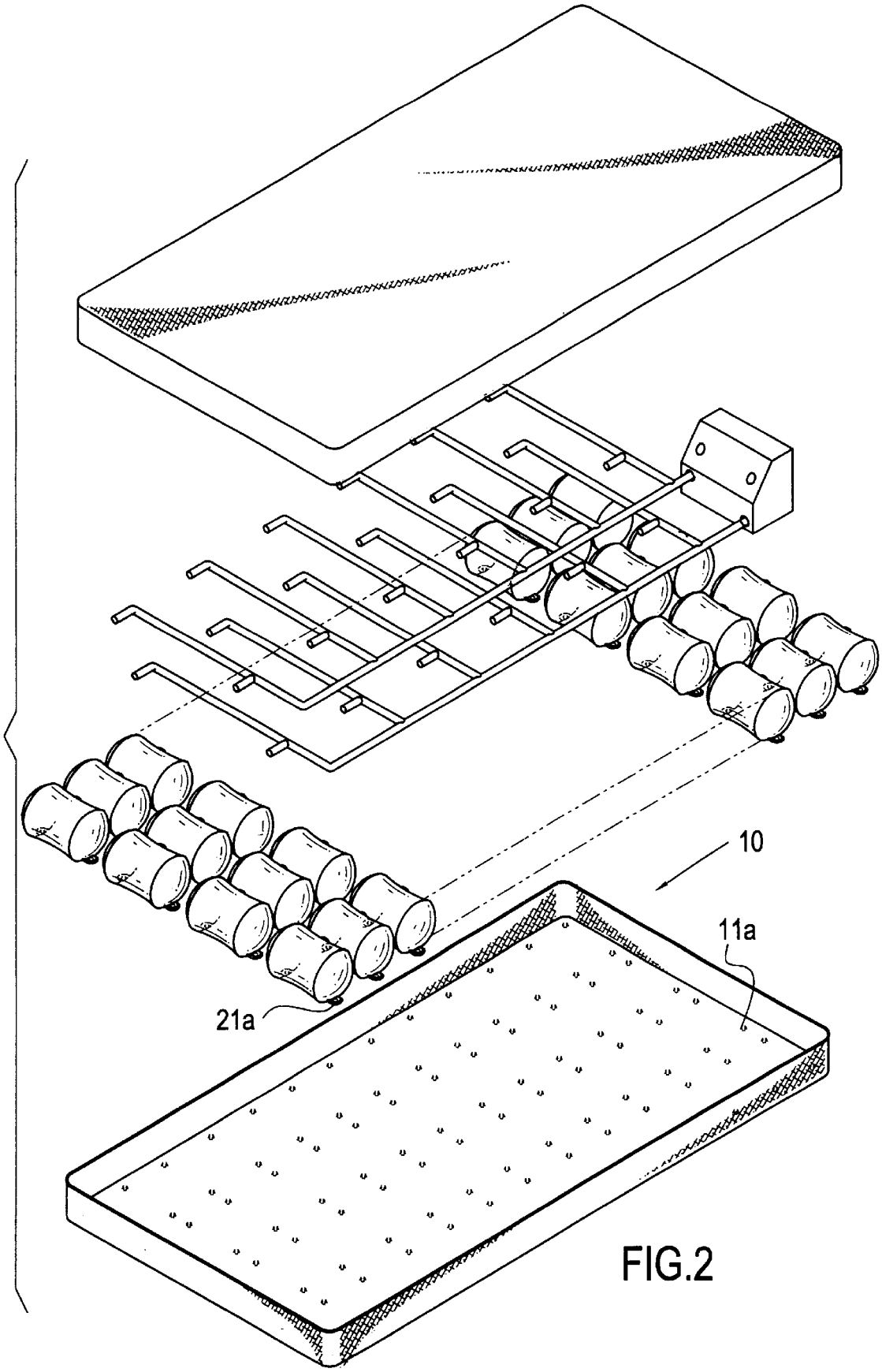
FIG. 2 is an exploded perspective view of a second embodiment of the modulated air cushion of the present invention.

With reference to FIG. 2, it is noted that the first bonding element (11*a*) comprises multiple pairs of buttons (11*a*) and the second bonding element (21*a*) comprises multiple pairs of loops (21*a*). Each pair of the loops (21*a*) is oppositely formed on a bottom face of a corresponding one of the air pouches (20) to correspond to one of the pairs of the buttons (11*a*) so that each of the air pouches (20) are attached to the top face of the base (10) via inserting each pair of buttons (11*a*) into the corresponding loops (21*a*).

Figure 3:
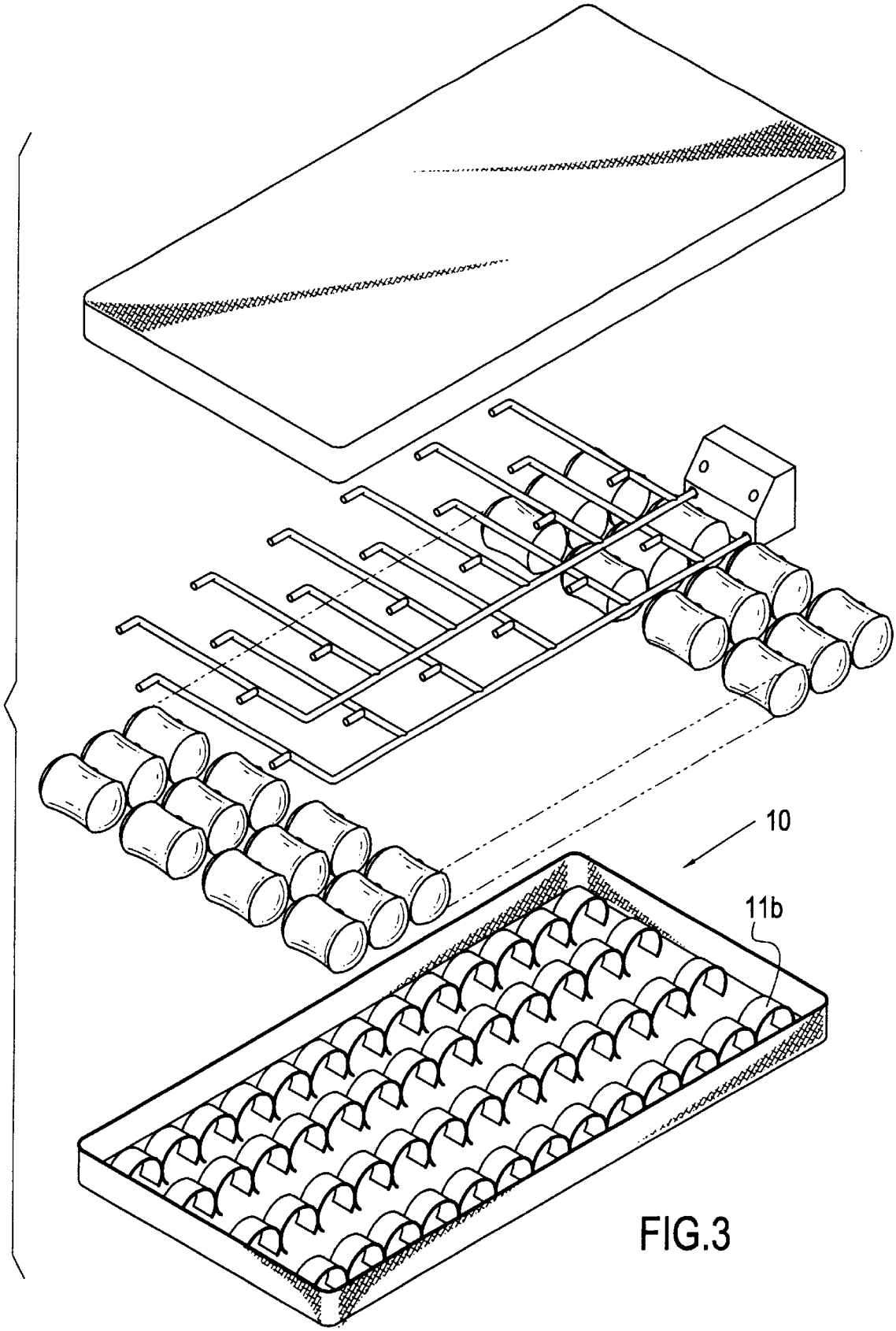
FIG. 3 is an exploded perspective view of a third embodiment of the modulated air cushion of the present invention.

With reference to FIG. 3, it is noted that there are multiple sustaining belts (11*b*) formed on the top face of the base (10) to correspond to each of the air pouches (20) so that each of the air pouches (20) are able to be attached to the top face of the base (10).

Figure 4:
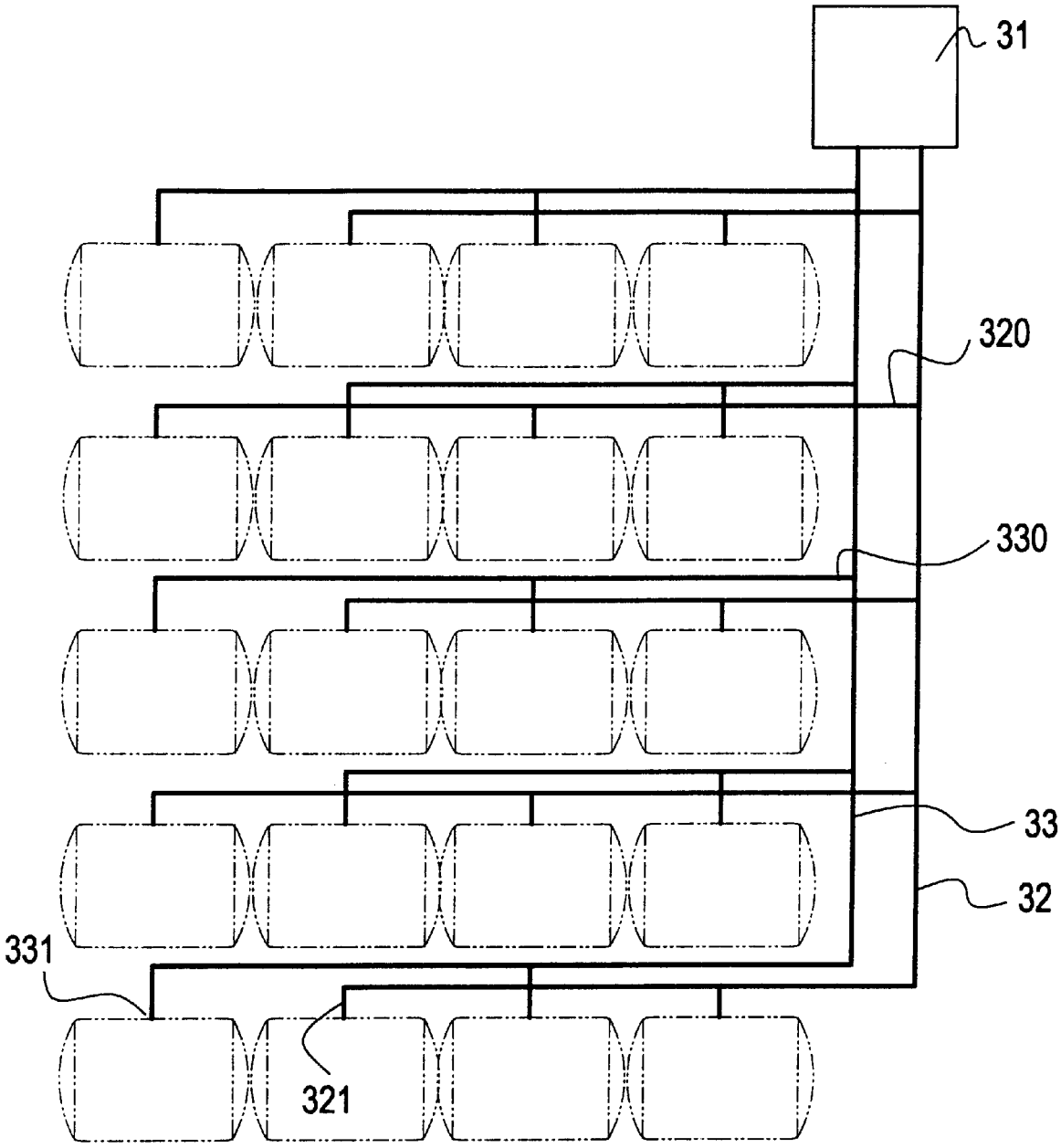
FIG. 4 is a schematic view of a first implementation of the air pump inflating the air pouches.

With reference to FIG. 4, each of the tubes (32,33) integrally have branches (320,330) and each of the branches (320,330) have air nozzles (321,331) corresponding to the inlets (22) on each of the air pouches (20). The branches (320,330) and the tubes (32,33) are so arranged that the air pouches (20) in odd rows in a 5×4 matrix are alternatively connected to the tube (32,33) and the air pouches (20) in even rows in the same 5×4 matrix are also alternatively connected to the tube (33,32). Because the controller (31) are able to be programmed, the air pouches (20) in the odd and even rows are able to be counterchangably inflated independently or simultaneously.

Figure 5:
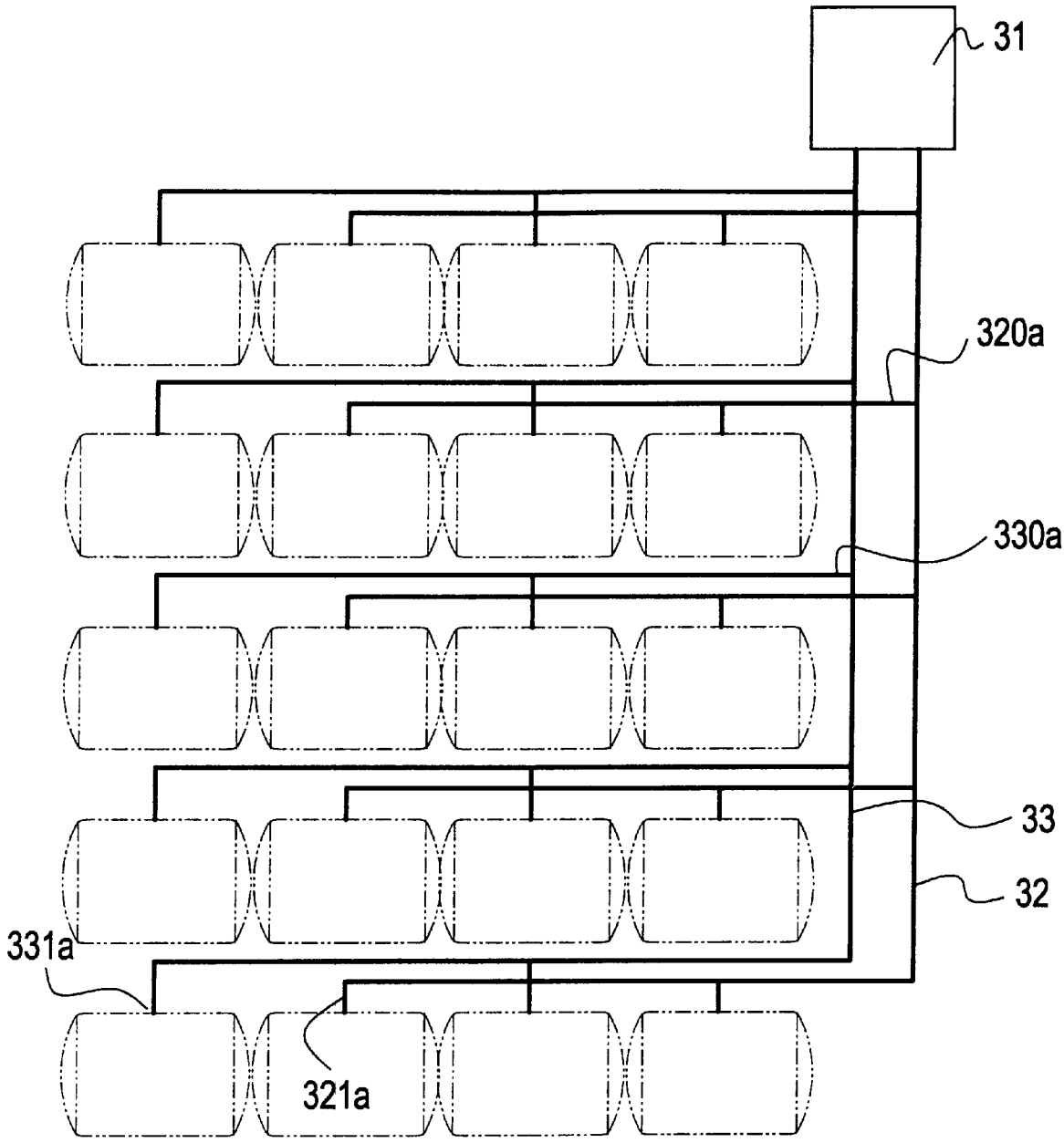
FIG. 5 is a schematic view of a second implementation of the air pump inflating the air pouches.

With reference to FIG. 5, each of the tubes (32,33) integrally have branches (320,330) and each of the branches (320,330) have air nozzles (321,331) corresponding to the inlets (22) on each of the air pouches (20). The branches (320,330) and the tubes (32,33) are so arranged that the air pouches (20) in odd rows in a 5×4 matrix are connected to the tube (32) and the air pouches (20) in even rows in the same 5×4 matrix are connected to the tube (33). Because the controller (31) are able to be programmed, the air pouches (20) in the odd and even rows are able to be inflated independently or simultaneously.

Figure 6:
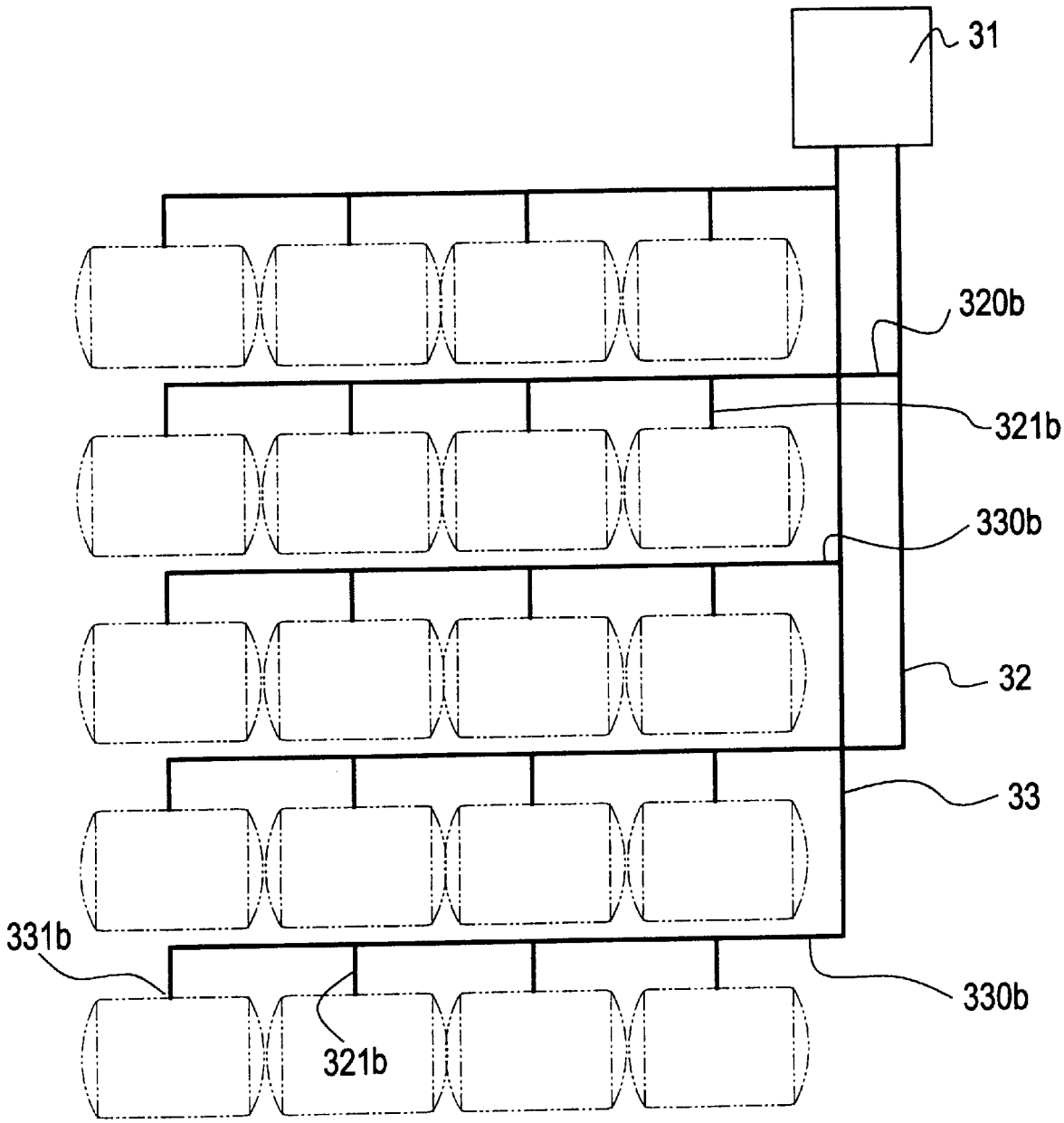
FIG. 6 is a schematic view of a third implementation of the air pump inflating the air pouches.

With reference to FIG. 6, the tubes (32,33) and the branches (320*a*,330*a*) are so arranged that the air pouches (20) in the even columns in a 5×4 matrix are connected to the tube (32) and the air pouches (20) in the odd columns in the same 5×4 matrix are connected to the tube (33). Because the controller (31) are able to be programmed, the air pouches (20) in the odd and even columns are able to be inflated independently or simultaneously.

Figure 7:
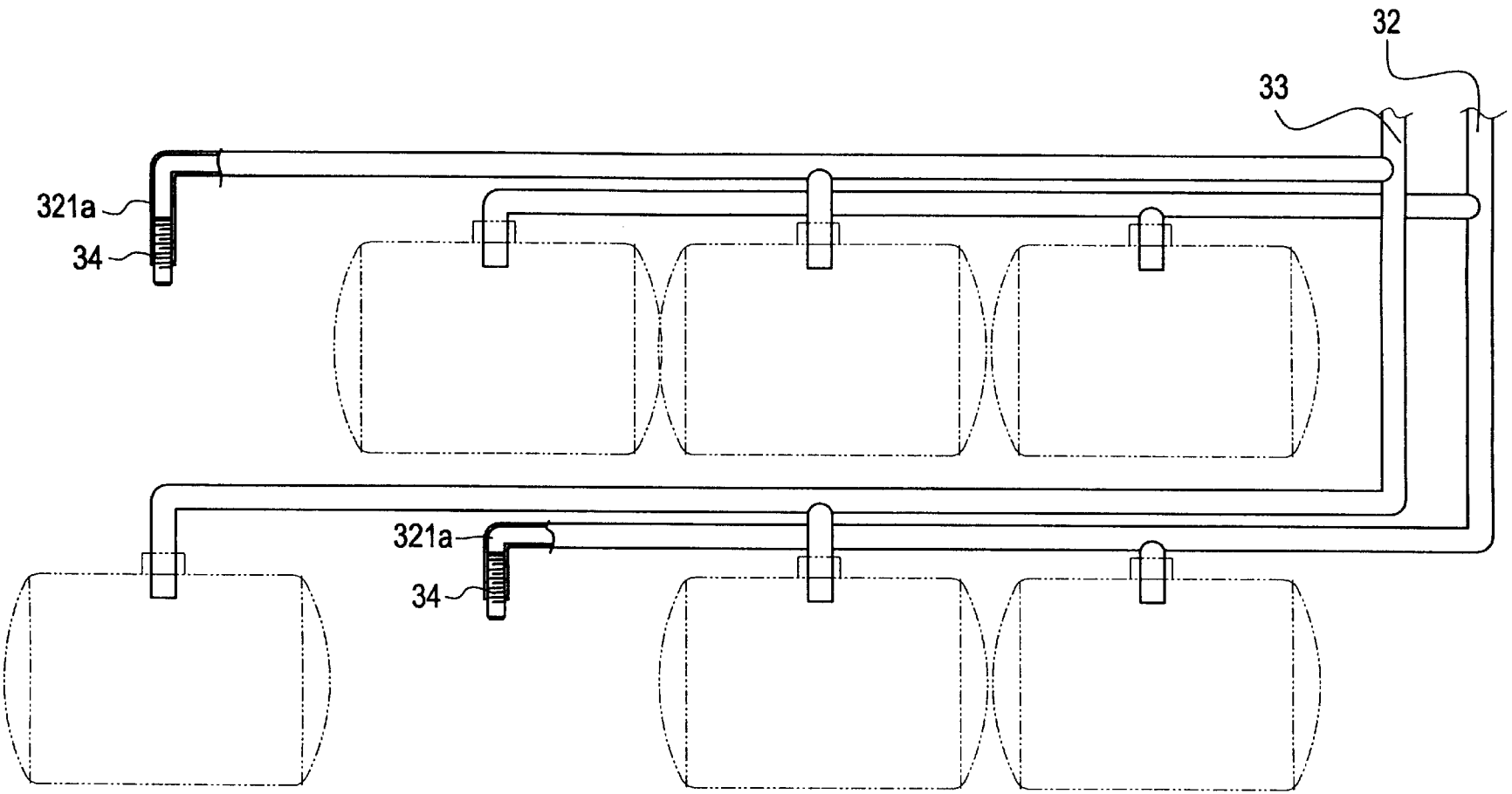
FIG. 7 is a schematic view of a plug that is provided to the nozzles of the tubes of the air pump.
Figure 8:
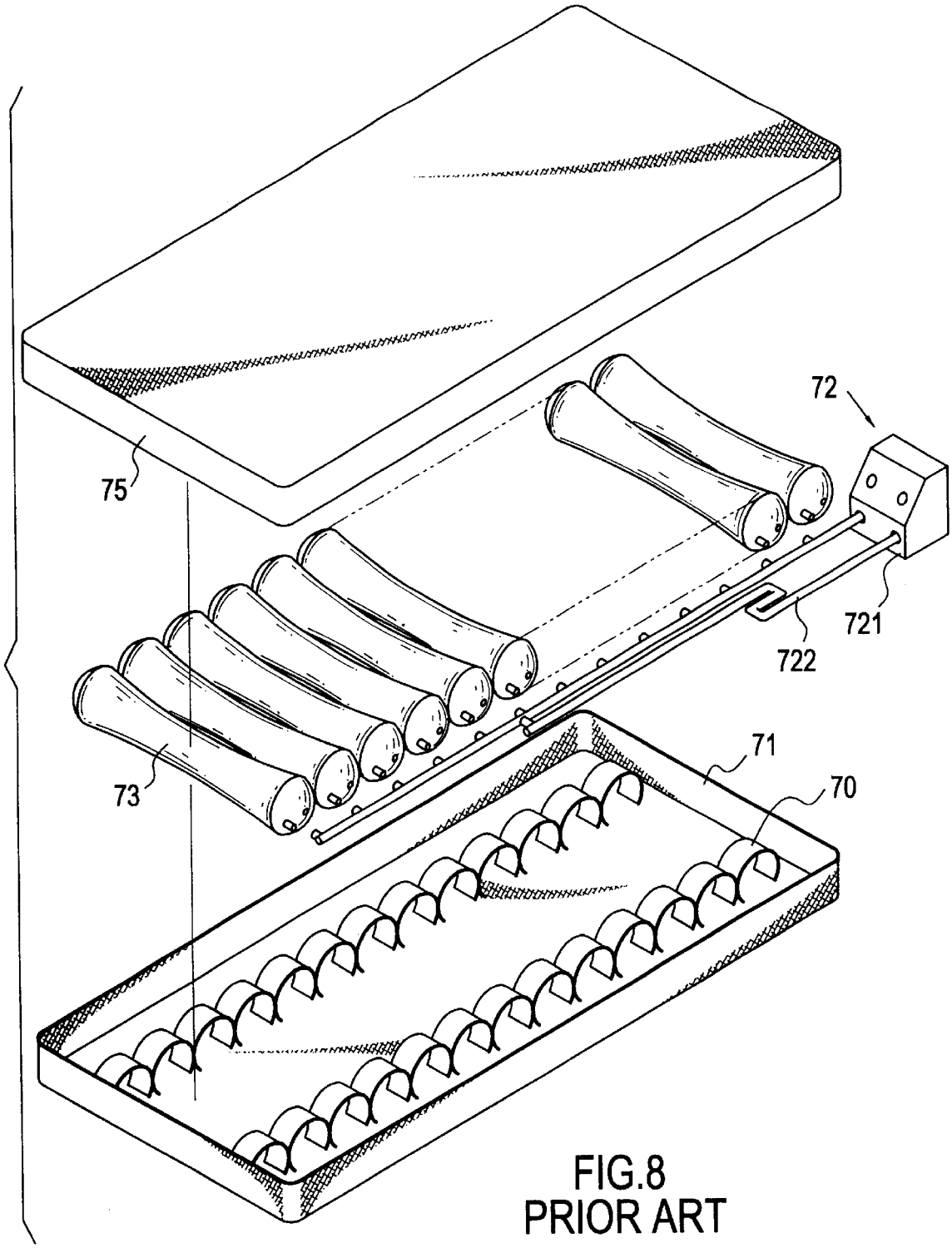
FIG.8 PRIOR ART
FIG. 8 is an exploded perspective view of a conventional cushioned bed.
Figure 9:
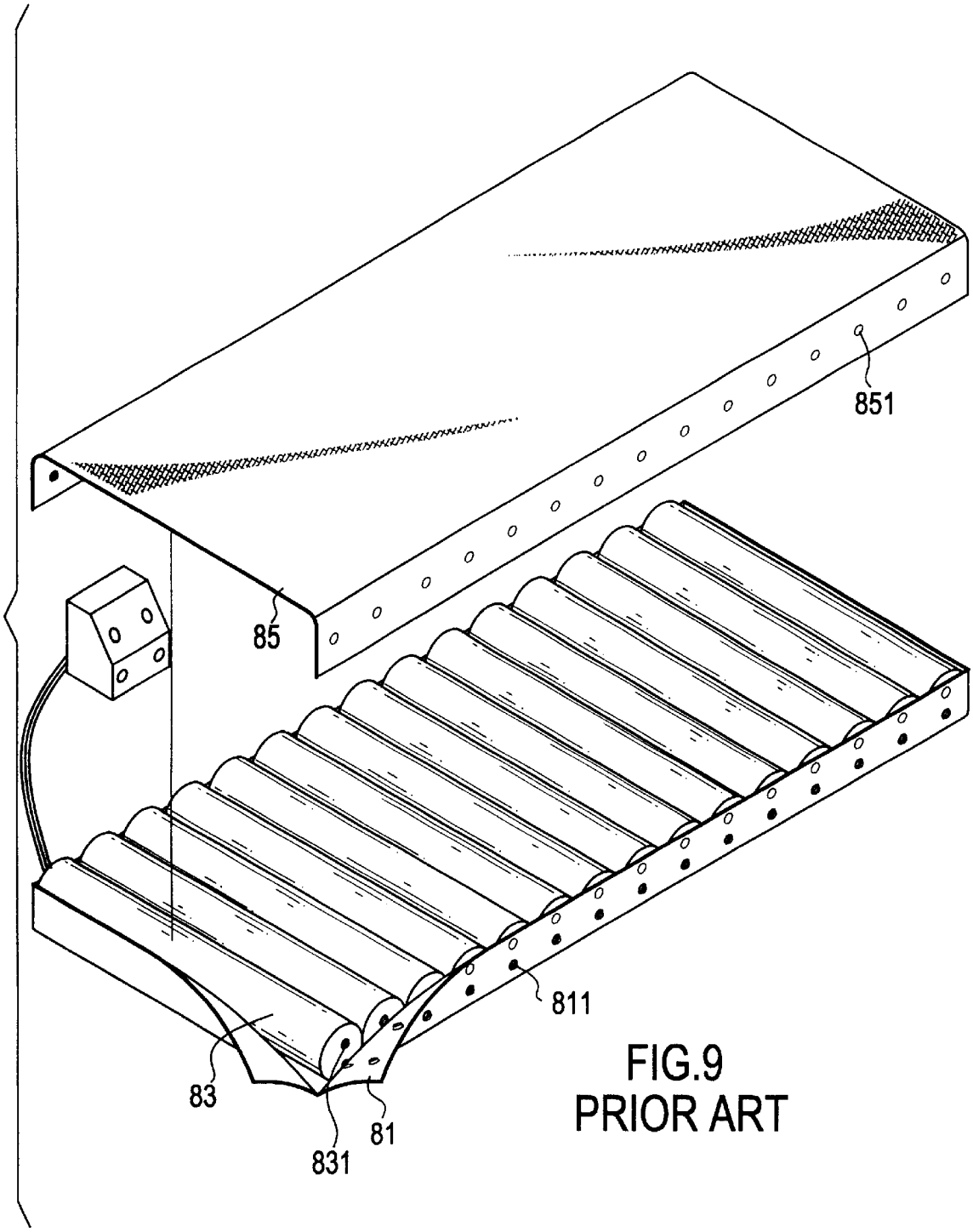
FIG.9 PRIOR ART
FIG. 9 is an exploded perspective view of a still conventional cushioned bed.

From the foregoing description, it is noted that the greatest advantage of the present invention is that any one of the air pouches (20) is able to be removed according to needs so as to cope with a specific area that can not have any air pouches (20). However, after a certain amount of the air pouches (20) are removed from the base (10), plugs (34) are provided to each of the air nozzles (321,331) to prevent leakage as shown in FIG. 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modulated air cushion comprising:

a base having a top face;

multiple air pouches removably attached to the top face of the base in a matrix arrangement via a bonding device; each air pouch having an inlet formed on the air pouch; wherein the bonding, device is a, loop and hook combination and an air pump having a controller, at least two tubes connected to the controller, each of the at least two tubes integrally having branches each provided with multiple air nozzles corresponding to the inlets of the air pouches, wherein each of the air nozzles are provided with a plug so that when a specific one of the air pouches is removed, the plug is able to be inserted into a corresponding one of the air nozzles to prevent leakage, whereby the air pump is able to inflate air pouches in odd and even columns independently or simultaneously.

2. A modulated air cushion comprising:

a base having a top face;

multiple air pouches removably attached to the top face of the base in a matrix arrangement via a bonding device; each air pouch having an inlet formed on the air pouch, wherein the bonding device comprises multiple pairs of buttons securely mounted on the top face of the base and multiple pairs of loops formed on opposite sides of each of the air pouches to correspond to the multiple pairs of buttons so that the air pouches are able to be removably mounted on the top face of the base; and an air pump having a controller, at least two tubes connected to the controller, each of the at least two tubes integrally having branches each provided with multiple air nozzles corresponding to the inlets of the air pouches, wherein each of the air nozzles are provided with a plug so that when a specific one of the air pouches is removed, the plug is able to be inserted into a corresponding one of the air nozzles to prevent leakage, whereby the air pump is able to inflate air pouches in odd and even columns independently or simultaneously.

3. A modulated air cushion comprising;

a base having a top face;

multiple air pouches removably attached to the top face of the base in a matrix arrangement via a bonding device which includes multiple loops formed on the top face of the base so that each of the air pouches is able to be received in a corresponding one of the loops to be removably mounted on the top face of the base, each air pouch having an inlet formed on the air pouch, wherein the bonding device comprises loops; and an air pump having a controller, at least two tubes connected to the controller, each of the at least two tubes integrally having branches each provided with multiple air nozzles corresponding to the inlets of the air pouches, wherein each of the air nozzles is provided with a plug so that when a specific one of the air pouches is removed, the plug is able to be inserted into a corresponding one of the air nozzles to prevent leakage, whereby the air pump is able to inflate air pouches in odd and even columns independently or simultaneously.

* * * * *